United States Patent [19]

Sewell et al.

[11] 3,938,441

[45] Feb. 17, 1976

[54] TERRAIN CLEARING DEVICE AND METHOD

[75] Inventors: Robert G. S. Sewell; Carl C. Halsey, both of China Lake, Calif.

[73] Assignee: The United States of America as represented by the Secretary of the Navy, Washington, D.C.

[22] Filed: Aug. 2, 1971

[21] Appl. No.: 168,359

[52] U.S. Cl. ..... 102/67; 102/5; 102/61

[51] Int. Cl.[2] ..... F42B 13/48

[58] Field of Search ..... 102/5, 61, 67

[56] References Cited

UNITED STATES PATENTS

| | | | |
|---|---|---|---|
| 1,301,098 | 4/1919 | Bull | 102/5 |
| 3,249,050 | 5/1966 | Cordle et al. | 102/67 |
| 3,298,308 | 1/1967 | Throner, Jr. | 102/67 |

*Primary Examiner*—Verlin R. Pendegrass

*Attorney, Agent, or Firm*—R. S. Sciascia; Roy Miller; Lloyd E. K. Pohl.

[57] ABSTRACT

A continuous rod warhead which utilizes ribbon shaped rods plug welded together at alternate ends to form a continuous rod bundle is used in terrain clearance. The warhead may either be dropped from an aircraft and contact exploded or hand placed and then exploded by any convenient means.

3 Claims, 4 Drawing Figures

*INVENTORS:*
ROBERT G. S. SEWELL
CARL C. HALSEY
*BY*: ROY MILLER
ATTORNEY.

TERRAIN CLEARING DEVICE AND METHOD

BACKGROUND OF THE INVENTION

1. Field of the Invention

This invention relates to a terrain clearing device and to methods for the use thereof. More particularly, this invention relates to an improved continuous rod warhead and to methods for its use in terrain clearance.

2. Description of the Prior Art

Continuous rod warheads are well known. A continuous rod warhead may be generally described as an explosive device having a continuous rod bundle affixed around the perimeter of an explosive charge. The rod bundle is constructed so that it may be either collapsed or expanded and is affixed around the charge in its collapsed configuration. When the charge is exploded, the blast causes the bundle to expand into a roughly circular projectile which is utilized to damage or destroy various targets. Prior art continuous rod bundles have primarily utilized hinge joints to attach the ends of the individual rods in the rod bundle together. A hinge joint is made up of a strong or primary weld at the immediate ends of two attached rods and a weak or secondary weld immediately adjacent to the primary weld. When a rod bundle is expanded, the rods spread outwardly from the hinge joints. If the welding has been done properly the secondary welds simultaneously give away during the expansion and, consequently, simultaneously place stress on the primary welds. If this occurs, the bundle will neatly expand into a roughly circular projectile. If, on the other hand, one of the secondary welds gives away too quickly placing immediate and violent stress on its adjacent primary weld, that portion of the rod bundle will be torn apart leaving a gap in the projectile pattern. Thus, it may be seen that the welding techniques required in the fabrication of hinge joints is necessarily sophisticated.

The need for quickly clearing bushes and trees from foliage covered terrain has long been recognized. For example, fire fighters need reliable methods for clearing access routes to forest fires and for providing fire breaks. Also, the various branches of the military service need reliable methods for quickly clearing wooded areas to provide helicopter landing zones, fire support bases, fields of fire, etc.

In the prior art, one method for clearing areas of foliage has been that of exploding a blast bomb just above the surface of the terrain. Blast bombs usually create large pits in the ground. Pits thus created make the areas unsatisfactory as helicopter landing zones. Pits also prohibit or hinder the passage of vehicles through an area thus cleared. Further, since such bombs explode above the ground they often merely topple or flatten the foliage at the points where it originally stood. When this results a large amount of cleanup time is required.

SUMMARY OF THE INVENTION

It has now been found that another explosive device, namely, a continuous rod warhead utilizing ribbon shaped rods plug welded together at their ends is an excellent terrain clearing device. The continuous rod warhead of this invention is particularly advantageous in that it does not blast large pits in the ground. It is further advantageous in that the expanding rod bundle and the force of the explosion work together to completely clear the area immediately around the explosion site. The device is exploded on the surface of the ground and the expanding continuous rod bundle severs the foliage in a circular area around the site of the explosion. Simultaneously, shock waves from the explosion force the severed foliage away from the explosion site. Thus, once the warhead has been placed and detonated, or dropped from an aircraft and contact exploded, the area is immediately ready to be utilized as a helicopter landing zone, fire lane or fire break. The use of plug welded ribbon shaped rods to form the continuous rod bundle has been found to be particularly advantageous. Ribbon shaped rods bend easily during expansion of the bundle. This permits the use of single plug welds in fabrication and eliminates the necessity for more complicated hinge welding techniques.

DESCRIPTION OF THE PREFERRED EMBODIMENT

Figure 1:
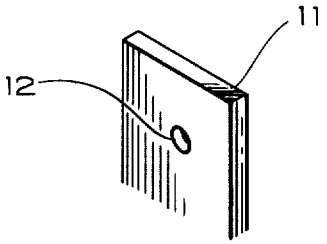
FIG. 1 is a perspective view of the end of a rod suitable for plug welding.

Going now to the drawing in which like or similar parts are indicated by like numerals, FIG. 1 is a perspective view of an end of a rod 11 suitable for plug welding. The rod contains a small hole 12 drilled therein.

Figure 2:
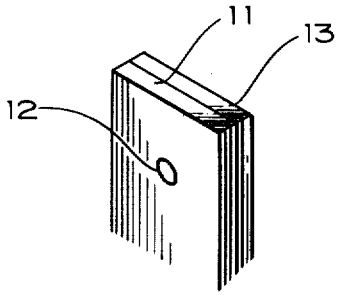
FIG. 2 is a perspective view of the ends of two rods plug welded together.

FIG. 2 is a perspective view of the ends of two rods plug welded together. One rod 11 has a hole 12 drilled therein and is placed adjacent to a rod 13 which has no holes drilled therein. The hole 12 in rod 11 is filled with welding material and the rods are firmly attached together.

To form a continuous rod bundle, a plurality of rods are plug welded together at alternate ends until a circular collapsed bundle is formed. Rod bundles may be made to have diameters almost any desired size. Once a bundle is fabricated it is ready to be placed in its collapsed condition around an explosive charge. Detonation of the explosive charge will then cause the rod bundle to expand outwardly into a circular projectile. In order to prevent adjacent rods from being explosively welded together when the explosive charge is detonated, it is preferable to have the individual rods in the collapsed bundle coated with a plastic material such as epoxy or with grease.

Figure 3:
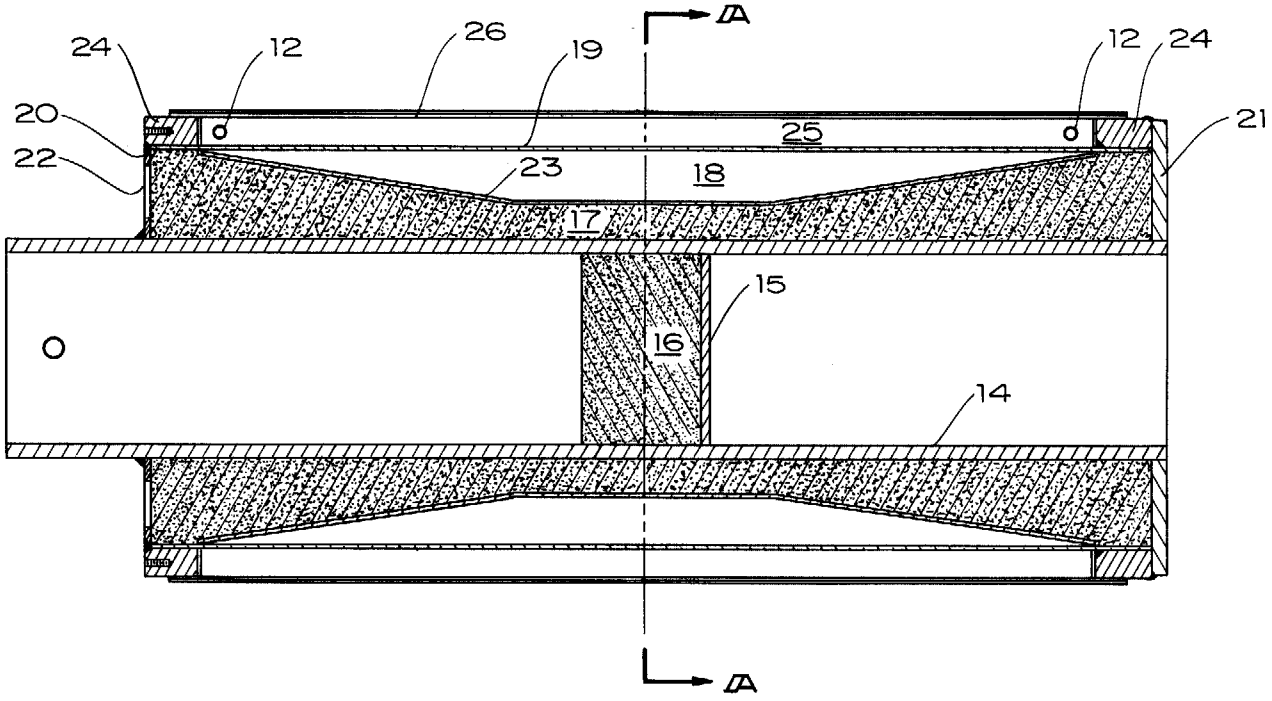
FIG. 3 is a cross sectional view of a continuous rod warhead according to this invention.

FIG. 3 is a cross sectional view of a continuous rod warhead according to this invention. The warhead is similar to prior art target destroying warheads with the exception that it contains a continuous rod bundle made up of plug welded ribbon shaped rods rather than hinge welded square rods. The warhead is made up of an interior tube 14 which contains a partition 15 dividing its interior into two sections and supporting an explosive ignition charge 16. Encircling the tube 14 is a shaped explosive charge 17 which is, in turn, encircled by an air space 18 and a second tube 19. The second tube is affixed in place around the shaped charge and attached to the interior tube by means of a filler plate 20 and an end plate 21. Welds are utilized to hold the plates and tubes in position. The filler plate has an opening 22 therein which permits pouring and casting of the shaped charge after the warhead has been assembled. Attached to the interior of the second tube is a form 23 which is utilized to give the desired shape to the shaped charge. Encircling both ends of the second tube are two collars 24 which abut against the ends of rod bundle 25 and help to hold the rod bundle in place around the exterior of the second tube. Encircling the rod bundle is an outer skin 26.

Figure 4:
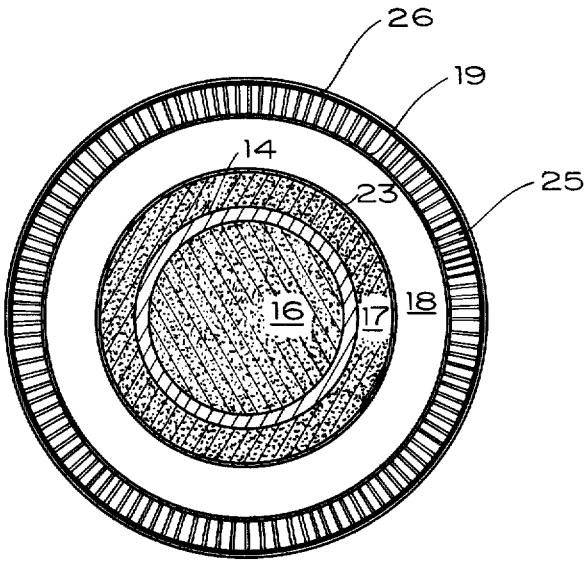
FIG. 4 is a section along lines A - A of FIG. 3.

FIG. 4 is a cross section taken along lines A - A of FIG. 3. FIG. 4 shows the interior tube 14, which contains the ignition charge 16 and is encircled by the shaped charge 17, the form 23, the air space 18, the second tube 19, the rod bundle 25, and the outer skin 26 in that order.

In performance tests utilizing plug welded rod bundles made up of rods having ⅛ by 1 by 36 inch dimensions and a 50 pound shaped explosive charge of composition B explosive yielded the following results:

TABLE

| Radius (ft) | No. of trees | No. of trees cut | Percent of trees cut |
|---|---|---|---|
| 10–20 | 22 | 22 | 100 |
| 20–30 | 13 | 12 | 92 |
| 30–40 | 18 | 17 | 94 |
| 40–50 | 8 | 7 | 88 |

The trees had diameters of up to about 12 inches. In addition to using composition B of the explosive composition C3, C4 and any other well known explosive can be used. Tests comparing square hinge welded rods with ribbon shaped plug welded rods showed that bundles utilizing plug welded ribbon shaped rods are superior to bundles utilizing square hinge welded rods. The welded bundles expanded more evenly into a smooth circular projectile than did the hinge welded bundles and the plug welded bundles exhibited less breakage in spite of the fact that the rod attachments were made by single welds rather than double (primary and secondary) welds. While rods having cross sectional sizes of ⅛ by 1 inch are specifically discussed above, other ribbon shaped rods having cross sectional sizes of up to about ½ inch by 2 ½ inches may be used with equal facility.

The size of the explosive charge required depends upon the weight of the rod bundle. For larger rods, up to 1000 pounds of explosive are needed to cause the bundle to expand with sufficient force to sever trees. On the other hand with smaller, lighter rods only about 50 pounds of explosive are required.

The shaped explosive charge of this invention can be cast into the device in any well known manner and the materials of the tubes and skin can be any of those commonly used to manufacture continuous rod warheads.

To clear terrain with the above described continuous rod warhead, the warhead, is either hand placed roughly in the center of the area that is to be cleared or air dropped from an aircraft. If the warhead is air dropped, it is provided with a contact fuse at one end and stabilizing fins at the other end. The stabilizing fins are necessary to insure that the warhead will strike the ground in a substantially upright position with the contact fuse striking first. If the warhead is hand placed, any well known means is suitable for detonation. Naturally, a person detonating a hand placed warhead must take care to do so from a position well away from the warhead. The person should also remain under cover. Rods breaking loose from an expanding bundle are capable of flying many hundreds and even thousands of feet and are very lethal.

What is claimed is:

1. Apparatus for terrain clearance which comprises:

a. a shaped explosive charge contained around its outer surface by a liner which gives the desired shape to said charge;

b. a continuous rod bundle which can be collapsed and expanded and which is fabricated from ribbon shaped rods plug welded together at alternate ends, said rod bundle being disposed in its collapsed configuration around the periphery of said shaped explosive charge in a tube, there being air space between the interior of said tube and said form which gives the desired shape to said charge; and c. means for detonating said shaped explosive charge.

2. Apparatus according to claim 1 wherein said shaped explosive charge is composition B explosive.

3. A method for clearing terrain of trees, said method comprising the steps of:

a. placing a terrain clearing device which utilizes a shaped explosive charge contained around its outer surface by a form to expand a continuous rod bundle fabricated from ribbon shaped rods plug welded together at alternate ends near the center of an area of the terrain which is to be cleared;

b. orienting said device so that when the continuous rod bundle is expanded it will expand parallel to the surface of the ground; and c. detonating said shaped explosive charge whereby said continuous rod bundle expands and cuts down said trees.

* * * * *